US005481985A

United States Patent [19]

Lin et al.

[11] Patent Number: 5,481,985

[45] Date of Patent: Jan. 9, 1996

[54] UNITARY BOWL LINER OF SUBSTANTIALLY RIGID SYNTHETIC RESIN FOR A BOLSTER OF A TRUCK

[75] Inventors: Mark W. Lin, Hillsdale; John T. Sarnicki, Elgin, both of Ill.

[73] Assignee: Standard Car Truck Company, Park Ridge, Ill.

[21] Appl. No.: 269,555

[22] Filed: Jul. 1, 1994

[51] Int. Cl.[6] ..... B61F 5/00

[52] U.S. Cl. ..... 105/199.4

[58] Field of Search ..... 105/199.3, 199.4; 384/422, 423

[56] References Cited

U.S. PATENT DOCUMENTS

| | | | |
|---|---|---|---|
| 3,944,298 | 3/1976 | Cannon | 105/199.4 |
| 3,986,752 | 10/1976 | Bogar et al. | 105/199.4 |
| 4,075,951 | 2/1978 | Chierici et al. | 105/199.4 |
| 4,174,140 | 11/1979 | Bogar et al. | 105/199.4 |
| 4,222,331 | 9/1980 | Gage et al. | 105/199.4 |
| 4,241,667 | 12/1980 | Wulff | 105/199.4 |
| 4,289,077 | 9/1981 | Kleykamp et al. | 105/199.4 |
| 4,308,801 | 1/1982 | Cooper et al. | 105/199.4 |
| 4,341,162 | 7/1982 | Mathieu | 105/199.4 |
| 4,353,311 | 10/1982 | Jantzen | 105/199.4 |
| 4,398,330 | 8/1983 | Meadows | 105/199.4 |
| 4,548,666 | 10/1985 | Mathieu | 105/199.4 |
| 5,228,393 | 7/1993 | Woolston | 105/199.4 |

*Primary Examiner*—Mark T. Le
*Attorney, Agent, or Firm*—Alfred D. Lobo

[57] ABSTRACT

A novel combination of a rail car supported on a within the center bowl of its truck bolster comprises a unitary wear liner closely fitted within the center bowl so as to require no exterior protection from grit and debris carried in the environment outside that of the center plate assembly held in the bowl. The unitary wear liner is required to be formed from specified reaction injection molded (RIM) polymers which when molded, are found to be free of microscopic voids >20 μm and therefore, fully dense. This property of being fully dense unexpectedly allows the liner to have specified physical properties which permit a railroad car truck equipped with the liners to operate with exceptional reliability, safety and for a long period of time.

19 Claims, 7 Drawing Sheets

UNITARY BOWL LINER OF SUBSTANTIALLY RIGID SYNTHETIC RESIN FOR A BOLSTER OF A TRUCK

BACKGROUND OF THE INVENTION

This invention relates to a bowl liner for a conventional truck of a railroad car. A railroad car is mounted on a truck assembly using a center plate assembly which is rotatably held in a bowl-shaped crater in the truck, familiarly referred to as the "bowl". The center plate assembly comprises a right-cylindrical center plate (vertical side wall and planar bottom in the horizontal plane). Since the center plate and bowl are each typically formed from cast steel, it is evident that direct contact of the center plate in the bowl would produce abrasive wear which would be unacceptable. To minimize the wear it has been conventional to interpose a metal wear plate between the center plate and the bowl with the expectation that the wear plate will be sacrificed in due course when it is replaced. A manganese steel liner is typically used between the center plate assembly on the car, and the bowl of the truck' bolster (see Car and Locomotive Cyclopedia, 1974 Edition at pages 513–25), the hardness of the liner being tailored to provide the wear resistance desired. To extend the expected useful life of the wear plate which is commonly made from a low-friction alloy, the wear plate is lubricated. In this scheme of operating a railroad car one can expect to re-lubricate a wear plate every 2–3 months, assuming the car travels, on average, 100,000 miles in a year.

To avoid the problem of re-lubricating the bowl, various liners of synthetic resinous material have been proposed with the avowed purpose of overcoming the cost of maintaining the bowl and center plate assembly as well as to avoid the use of lubricant which gets ejected and distributed on the rail tracks and the ground thereunder, when the railroad car is in motion.

As long as eighteen years ago, in U.S. Pat. No. 3,944,298 to Cannon, it was proposed to keep the conventional vertical metal split-ring wear liner in the bowl, but to substitute a "flat disc of plastic material" for the conventional metal horizontal wear liner. Use of the metal vertical wear liner required lubrication which deleteriously affected the "plastic material". Further, even without fragmentation, when normal wear of the metal liner occurred, grit was lodged between the center plate and the bowl liner, damaging the liner. The "plastic material" is identified therein as being "low friction, semi-flexible, high-load carrying ability" (see col 2, lines 45–46), and commercially available under the Pennlon® brand name, sold by Dixon Corporation. Cannon believed that by using only the horizontal wear liner, the problems associated with movement of a unitary bowl liner would be minimized, if not obviated. They were not, as evidenced by the failure of the substitute Pennlon® wear liner, known to be high molecular weight polyolefin (believed to be polyethylene) to provide satisfactory service.

Recognizing the promise of high molecular weight polyolefin material, about sixteen years ago, Chierici et al disclosed the use of a bowl liner of ultrahigh molecular weight (UHMW) high density polyethylene (PE) in U.S. Pat. No. 4,075,951. Despite the long period over which worrisome details of such bowl liners could have been ironed out they have not been satisfactory, mainly because they were unduly sensitive to thermal degradation and to compressive deformation. It was assumed that the polyolefin would be adequately insensitive to the relative movement of a unitary bowl liner, relative to both the center plate and the bowl, which movement, in a rail car carrying a normal load for which it is designed, generates a large abrasive force. There is no indication in the art as to what the response of a polyolefin bowl liner was to the abrasive action of grit.

It is generally acknowledged that the deficiency of the Pennlon® and UHMW PE bowl liners was that neither was sufficiently stable under conditions of elevated temperature and pressure, and that they failed because of the peculiar resilient and elastomeric characteristics of the polyolefin which rendered it pliable. Further, with relative movement of a unitary bowl liner at elevated temperature in the range above 43.3° C. (110° F.), prior art bowl liners are so sensitive to compressive deformation that the useful life of a prior art "plastic" bowl liner in a rail car is less than that of a conventionally lubricated metal wear plate and vertical wear liner.

It is more critical that the polymer matrix of a satisfactory bowl liner be substantially rigid, than it is that there be low sliding friction between the center plate and the bowl. By "substantially rigid" is meant that the polymeric liner used herein, when subjected to a distortion force normally encountered within the environment of a bolster's center bowl at ambient temperature, is capable of resisting the distortion force applied to the liner as it is oriented in the bowl, and capable of maintaining the liner's formational shape thereafter. Further, a material which is substantially rigid is not pliable, that is, not bendable or shapeable without being damaged, after the shaped material is removed from a RIM machine.

Unlike the prior art which sought to substitute a pliable plastic material for the conventional metal wear liner, it was decided to test a polymer matrix which emulated, to as large an extent as practical, the physical properties of the metal wear liner. Thus, the polymer matrix of the liner used herein is non-extensible in the temperature range from 25° C. to about 100° C., therefore non-pliable and essentially non-deformable, and cannot have a 300% modulus which characterizes an elastomer. The term "elastomer" is used herein in its accepted meaning to refer to "a polymeric material such as a synthetic rubber or plastic, which at room temperature can be stretched under low stress to at least twice its original length and upon immediate release of the stress returns with force to its approximate original length (McGraw Hill Dictionary of Scientific and Technical Terms, pg 648, 5th Edition, McGraw Hill Book Co.).

High friction forces are known to generate temperatures in the range from 110° F.– 250° F. at which compressive deformation of the liner is instrumental in the derailment of cars, particularly 125-ton articulated double stack rail cars. Therefore, routinely, one skilled in the art seeks to minimize the sliding friction by manipulating such properties as the material of the wear plate, or bowl liner, the surface condition of each of the components of the center plate and bowl assembly, the contamination of those surfaces by foreign matter, and the type of lubricant, if one is used. Clearly, one cannot expect to control the ambient temperature and it is unrealistic to seek to operate a car with a load much smaller than the load it is designed to carry.

SUMMARY OF THE INVENTION

It has been discovered that only a unitary synthetic resinous bowl liner interposed between a steel center plate of a rail car and a steel bowl of the car's bolster, provides safe and long-lived service, provided the bowl liner is formed from particular polymers which are reaction injection molded (RIM) to be "fully dense", and further providing that the fully dense polymer matrix formed has essentially no compressive deformation.

By "fully dense" is meant that there is no statistically significant number of microscopic voids larger than 20 μm, and preferably not larger than 10 μm, present in the matrix. By "essentially no compressive deformation" or "essentially non-deformable" is meant that the material has a compressive deformation of less than 1% at 38° C. (100° F.), and more importantly, <5% at 177° C. (350° F.) under a load which produces about 6,890 kPa (1000 psi) pressure, indicating the material is essentially incompressible in the stated temperature range under the operating conditions for a truck.

Moreover, it has been discovered that a fully dense RIM polymer, and specifically one chosen from those which are specified herein, has the unique property of being essentially immune to abrasion due to hard granular particles such as sand and brake shoe debris. Tests conducted under simulated actual service conditions indicate less than a 10% increase in maximum friction force when compared to the maximum friction force generated under "clean" conditions (no contaminant). In many instances, the RIM polymer contributes the unique property of being lubricated by finely ground inorganic granular material such as sand and brake shoe debris, smaller than about 70 mesh (U.S. Standard Sieve Series) or 212 μm (micrometers) nominal diameter. As a result, it is unnecessary to provide a cover to keep out debris from the bowl of a bolster.

To meet the requirements for economically producing a dimensionally accurate unitary bowl liner which operates satisfactorily, that is, with desirable lubricity and friction characteristics, thermal and oxidative stability, and toughness, it is critical that the bowl liner be stable to thermal and oxidative degradation at about 177° C. (350° F.), the upper limit of temperature encountered during operation of the friction wedge in the truck of a railroad car.

By "stable to thermal and oxidative degradation" is meant that it is critical that the bowl liner be essentially non-deformable at a temperature as high as 177° C.; and that its energy loss, as calculated from a hysterisis curve, be no greater than 25%, the basis for comparison being acicular cast iron. The comparison was made between acicular cast iron because its properties are believed to be comparable to those of a typical alloy wear liner used in a conventional lubricated bowl liner. Such thermal stability is most preferably provided by a liner of a specified RIM polymer matrix infused, during formation of the matrix, with a minor amount by weight of a polyolefin. The polyolefin is present as a disperse phase in the specified RIM multi-phase polymer matrix wherein hard segments of chains of reacted polymer in the matrix provide the continuous phase. The polyolefin particles are believed to stop crack propagation in the matrix, functioning not only as an impact modifier, improving modulus, toughness and wear resistance, but also to minimize microscopic voids so as to produce a fully dense, essentially non-deformable (at 38° C.) matrix having a durometer hardness in the range from 70–90 Shore D and desirable lubricity. Yet, a PE-containing RIM polymer matrix has unique abrasion resistance, particularly to sliding abrasion, by lowering the coefficient of sliding friction for the polymer matrix.

It is particularly unexpected that despite the relative softness (63–65 Shore D) of PE particles dispersed in the polymer matrix, and the known proclivity of dispersed PE particles to reduce the density of the matrix, the rigidity of the polymer matrix is maintained and its contaminated (with grit) abrasion resistance is within 10% of the abrasion resistance of clean RIM polymer.

The novel unitary bowl liner of the RIM polymer not only produces the stated small energy loss but exhibits minimal wear on the surfaces of the center plate and bowl, thus making lubrication of the bowl not only unnecessary, but undesirable. Such wear as does occur, is minimized because the center plate assembly has a shape corresponding to that of the center bowl of the bolster, except the dimensions of the assembly are uniformly diminished vertically and radially inwards from those of the bowl's surface by a distance corresponding to the uniform thickness of the unitary liner. The liner is molded to have an exterior surface which conforms to the bowl's inner surface before the center plate is thrust into the bowl, and the liner has an inner surface which conforms to the center plate assembly's exterior surface at room temperature.

It is therefore a general object of this invention to provide a bowl liner comprising, a unitary liner having a horizontal planar bottom portion and a vertical cylindrical wall portion smoothly blended into said bottom portion at its circumferential periphery. The unitary liner, having a substantially uniform thickness in the range from 0.315–1.28 cm (0.125"–0.50"), is dimensioned to fit snugly within the bowl so as to be subjected to minimal flexing, and to be removable when the liner is to be replaced. The liner consists essentially of a reaction injection molded polymer matrix essentially free of microscopic voids >10 μm in diameter, and more preferably >5 μm, which matrix is fully dense, substantially rigid as evidenced by a shear modulus >517,000 kPa (75,000 psi), and essentially non-deformable as evidenced by a compressive deformation of <5% at 177° C. Further, when sand and other inorganic particulate contaminants are introduced between the surface of the liner and the steel surfaces of the center plate and bowl, the friction force generated is no more than 10% greater than that generated between clean surfaces (free of contaminant).

It is a specific object of this invention to provide a bowl liner of non-deformable RIM polymer matrix having dispersed therein a minor proportion by weight of a polyolefin present as a disperse phase, the polyolefin being selected from the group consisting of polyethylene (PE) and polypropylene (PP).

It is another specific object of this invention to provide a unitary bowl liner of a RIM polymer matrix having a tensile strength of at least 27,500 kPa (4000 psi), preferably from 34,500 to 55,000 kPa (5000–8000 psi) measured at 25° C., the molded bowl shape being essentially uniform in cross-sectional thickness, and which bowl shape conforms closely to the inner surface of the center bowl in a truck bolster, the net effect being to minimize wear on the steel surfaces of the bowl and center plate assembly.

The RIM polymer matrix component is selected from the group consisting of an essentially non-elastomeric, non-deformable, substantially thermoplastic copolymer, and an essentially non-deformable, substantially cross-linked polymer which is not thermoplastic. Preferred are (i) a triblock copolymer of a polyol prepolymer and a ring-openable lactam, referred to herein by the code XP-91; (ii) a substantially crosslinked polyurea or polyurethane; (iii) a substantially crosslinked polymer of one (homopolymer) or more (copolymer) cyclodiolefins; mid (iv) nylon, each of which is RIM. Most preferred is one of the foregoing RIM polymers containing from 1 to about 20% by weight, preferably about 5 to 15% by weight, of surface-modified PE dispersed throughout the polymer matrix. The phrase "sufficiently crosslinked to provide a substantially rigid matrix" is used to refer to a RIM polymer which has the physical properties described below.

It is a specific object of this invention to provide a liner formed from a polymer matrix having dispersed therein from about 1–10 percent by weight of surface-modified PE, based on the weight of the polymeric liner, in a matrix which has a durometer hardness of at least 70 Shore D, preferably more than 75; a modulus of elasticity in tension (tension modulus) of at least 1,034 MPa (150,000 psi); a modulus of elasticity in shear (shear modulus) of at least 689,000 kPa (100,000 psi); all measured at room temperature 25.5° C. (78° F.); and lower compression deformation than any of the following: (a) ultrahigh molecular weight (UHMW) polyethylene (PE); (b) cast polyurethane having <70 Shore D hardness; (c) cast molybdenum-filled polyurethane (UMF) having <70 Shore D. The compressive deformation of the liner, molded as a multi-phase polymer matrix, is required to be <1% at 38° C. (100° F.), <5% at 177° C. (350° F.), and more preferably, <0.5% at 38° C., and <2.5% at 177° C. The foregoing properties are obtained in the best mode of the invention wherein the liner is formed from a commercially available Nyrim® polymer infused with <10 parts by weight of surface-modified PE which provides a coefficient of "sliding" friction in the range from 0.5 to 0.8., measured by a center bowl liner test performed under AAR (American Association of Railroads) specifications with an external vertical load of 560,500 N (126 kips) in the range from 133,500–178,000 N (30–40 kips) between clean steel surfaces at ambient temperature (25.5° C.).

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

Figure 1:
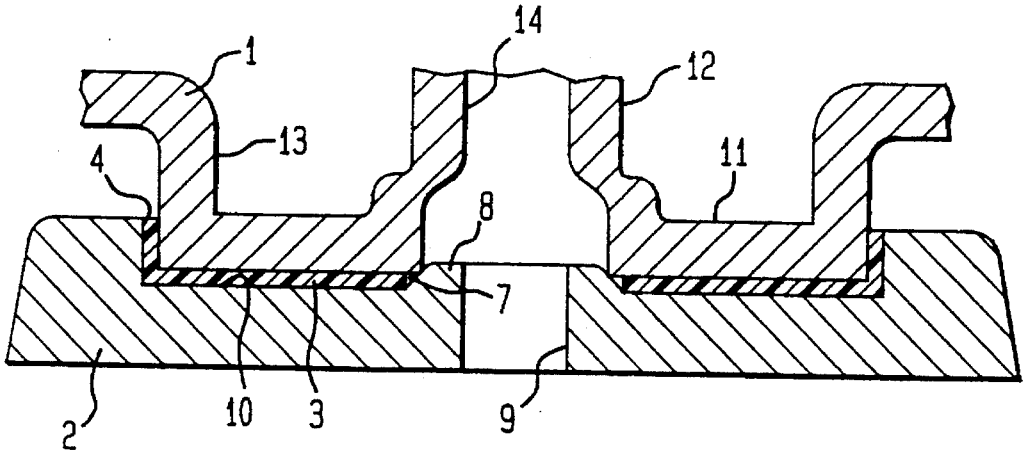
FIG. 1 is a broken away vertical cross-sectional view through a center plate assembly of a truck bolster, illustrating one arrangement of the center plate components and self-lubricating unitary liner.

Referring to FIG. 1, there is schematically illustrated a portion of a body center plate 1 of the body bolster of the lower structural portion of a railroad car comprising an underframe which is swivelably supported in a central bowl 2 of a truck bolster. The car's body is supported on unitary liner 3 by a center plate assembly having a center plate 11 from the center of which projects a stepped sleeve 12 for passage of a kingpin (not shown). The center plate 11 has a cylindrical wall 13 rising vertically from the plate's periphery to form a projection with a right-cylindrical shape. The sleeve 12 is provided with a stepped passage 14, and center plate 11 is provided with a passage 9, the passages being coaxially aligned to receive the kingpin. Each of the foregoing structural features of a railroad car are conventional. The unitary liner, indicated generally by reference numeral 3, is snugly nested in bowl 2, interposed between the center plate 11 and the floor of the bowl 2, so that the outer surface of the liner coextensively abuts the vertical cylindrical side wall 4 and the floor of the bowl.

The unitary RIM liner may only be formed by RIM or it will not be fully dense. The liner so formed, being substantially rigid, essentially non-deformable and not pliable, like the metal wear liner it replaces, will be permanently deformed if stressed to its elastic limit. The elongation at break is less than 100% at 25 C. (room temp) and typically in the range from 30–60%. The inside diameter of the liner 3 is chosen to slidably snugly accommodate the center plate 11. The center plate 11 is provided with a circumferential bevel 10 because it is well known that a rail car in motion produces a rocking motion relative to the truck bolster, and the bevel diffuses the forces exerted on the inner radius of the liner.

Figure 2:
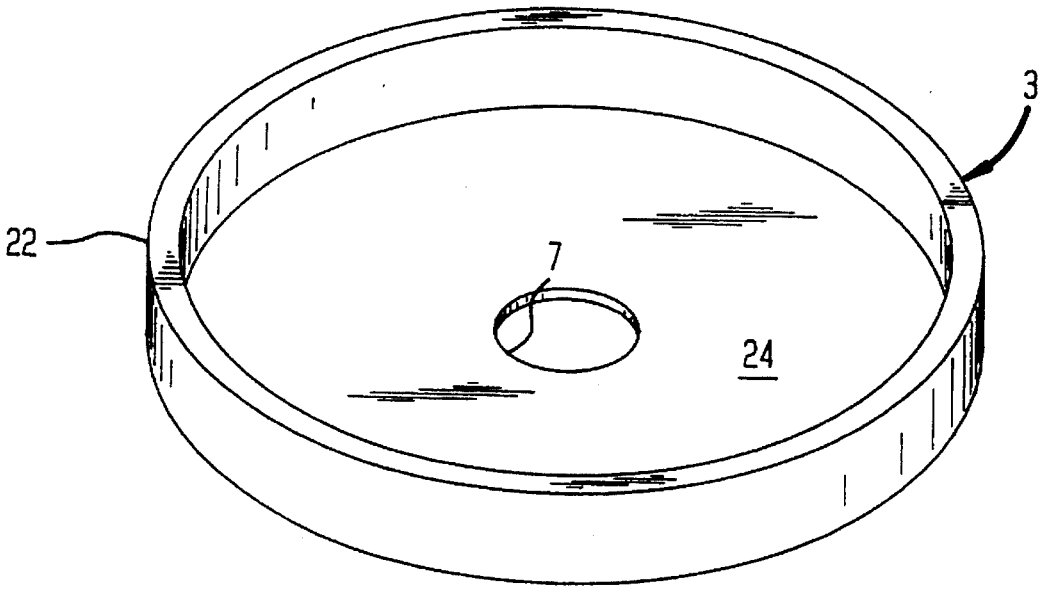
FIG. 2 is a perspective view, slightly in elevation, of the unitary liner.

Referring to FIG. 2, the bowl-shaped liner 3 is provided with a disc portion 24 and a circumferentially continuous cylindrical vertical wall 22 rising to the lip of the bowl from the periphery of the disc 24 which is provided with a central bore 7. A boss 8 in the center of the bowl 2, is inserted through the bore 7 to center the inner liner in the bowl. Like the liner disclosed in the '951 patent, but unlike the liner disclosed in U.S. Pat. No. 4,222,331 to Gage, the vertical wall 22 and disc 24 are smoothly blended at the periphery of the disc with a short radius to lie snugly against the inner wall 4 of the bowl 2, to minimize the impact of the center plate 11 on the liner 3. This construction, disclosed in the '951 patent, uses a liner of substantially uniform thickness, no more than about 0.95 cm (0.375") thick.

Wear on the liner is especially serious in high mileage, high utilization railroad cars, such as those on unit coal trains, and trains in dedicated service hauling heavy loads to a designated site. Over a period of many months, usually years, the relative movement of bolster and side frame causes wear which is due to a combination of "hunting," the rock and roll action of a freight car on rough track, and the action of the truck passing through a switch wherein the bolster may move laterally relative to the side frames. Such wear due to the motion of a rail car is well known, normally, to be exacerbated by grit which finds its way into the center bowl and lodges between the surfaces of the center plate and liner. Whatever the causes of wear, wear in the bowl, and on the liner, is unexpectedly small when a RIM liner is used.

The surprising lack of abrasive wear on a polyethylene-filled Nyrim® liner is demonstrated by experimental studies conducted with a hydraulically actuated test machine having a center plate the motion of which could be controlled in a bolster bowl. The motion of the center plate was controlled to simulate the movement of a center plate in a moving car under actual service conditions.

The test machine comprised a vertical loading device, support beams, sliding drive rod, upper contact plate, test sample, modified bolster, and friction measurement device. Two identical polymer specimens were tested, one under clean, the other under contaminated conditions. The contaminant used was equal parts by volume (0.25 $in^3$) of a mixture of sharp sand about 198 μm in nominal diameter which passed through 70 mesh, and powdery brake shoe debris.

Each test series was evaluated for 50,000 cycles which represented 1 year of rail service. The maximum observed friction was measured and recorded, and these data were used to derive a ratio between the clean and contaminated surfaces. The ratio was defined as the index number. An index number >1 indicates the contaminant induces a friction force greater than that induced by a clean surface; an index number <1 indicates the contaminant induces a friction force less than that induced by a clean surface. Though in most cases the test results indicate that the sliding friction between contaminated surfaces is no more than 10% greater than between clean surfaces, depending upon the characteristics of the contaminant, it can act as a solid lubricant.

The test conditions were as follows:

1. The center plate and bolster bowl surfaces are sand blasted to ensure a clean surface.
2. 8.2 ml (0.5 $in^3$) of the contaminant was distributed evenly over the surface of the liner's disc.
3. The vertical load P was set by compressing a double nest of springs to the loaded spring height equal to 126 kips.
4. The test was initiated, and computers were used to monitor and record the highest observed movement of each component.
5. The rock and roll actuator induced one actuation every 2 sec, with 0.5 sec pause each time it passed the horizontal position.
6. The yaw actuator cycled once every 6 sec; the angle of yaw is about ±3°.
7. Data were collected every 1.5 hr; only the maximum friction value for each interval was recorded.

The initial friction forces (in the center bowl liner test) between (a) the clean surfaces was 4,152 lb (18,469N) and incrementally stepped to 6,573 lb (29,238N) after 10 hr; (b) the contaminated surfaces was 4,500 lb (20,017N) and progressively climbed to 6,923 lb (30,795N) and finished at 7,270 lb (32,339N) after 10 hr. The increase in friction force between contaminated surfaces, over time, is attributable to the greater increase in temperature between the contaminated surfaces than that between clean surfaces.

The friction indices are as follows:

4,500/4,152=1.084;

6,923/6,573=1.06;

7,270/6,573=1.106 based on time on test

As stated above, the novel unitary liner is required to be made in a conventional RIM process using a die having matched upper and lower mold members gated at a parting line. The interior mold surfaces of the upper and lower mold members define a mold cavity having the desired dimensions of the liner. After the upper mold member is closed upon and locked to the lower mold member with a clamping force in the range from 10–50 tons, the components of the polymer matrix to be formed are injected into the mold cavity. The components are typically stored as free-flowing liquids having a viscosity in the range from 0.1–1 Pa.sec (0.02–0.2 cp), in tanks at a temperature in the range from 150°–200° F. and the mold is maintained at a temperature of about 60°–150° C., preferably about 121° C. (250° F.). A liner may be demolded soon after the matrix is cured in the mold, usually within less than 10 minutes, preferably within 3–5 min. The RIM process is practiced in a conventional RIM machine or a Resin Transfer Molding (RTM) machine, at an autogenous molding pressure in the range from 350–700 kPa (50–100 psi) developed during the curing of the resin due to the exotherm.

In an illustrative example in which all parts refer to parts by weight, a two-part mixture is injected into the mold. One part, Part A, is a mixture of 21 parts polyether polyol prepolymer such as poly(tetramethylene oxide) diol, 25 parts caprolactam, 4 parts surface-modified polyethylene, and 0.5 parts of an antioxidant. The other part, Part B, is a mixture of 39 parts caprolactam and 11 parts $MgBr_2$ catalyst. When the components are mixed, the catalyst generates 6-nylon or nylon-6 by ring-opening and homopolymerizing the caprolactam until the growing chain encounters a polyol chain. When this happens the terminal —OH group of the glycol, specifically an alpha,omega-diol, is connected with the growing amine chain end of the nylon-6 through an ester linkage. The same ester linkage is generated at the other, still unreacted end of the glycol, thus linking another nylon-6 chain. In a mass of the resulting polymer, a phase separation occurs in which the prepolymer molecules provide the disperse phase, along with the polyethylene which, of course, does not take part in the chemical reaction but functions as a filler which modifies the lubricity of the polymer matrix formed. The cured polymer matrix of the liner has a Shore D in the range from 75–80. The hardness may be increased by increasing the ratio of caprolactam to polyol since the caprolactam forms a poly(caprolactone) soft segment and the polyol forms a hard segment in a chain of the polymer formed.

In an analogous manner, a polyurethane or polyurea RIM polymer matrix may be formed with soft segments generated with monomers analogous to those used for the soft segment of the triblock. For example, soft segments may be chosen from prepolymers of polyester and polyether diols, based on polyoxypropylene polyols, polycaprolactone, polytetramethylene oxide glycols, polybutylene oxide glycol, and poly(dimethylsiloxane) diol, in turn derived from propylene oxide, ethylene oxide, tetrahydrofuran, dimethylsiloxane, and the like. The hard segments of a polyurethane may be chosen from p,p'-diphenylmethane diisocyanate (MDI), toluene diisocyanate (TDI), hexamethylene diisocyanate (HMDI) and the like. As in the triblock, each of the RIM polymers formed may include less than 10 parts, and preferably about 5 parts by weight of surface-modified polyethylene such as Primax® UH-1000 Series UHMW PE particles sold by Air Products and Chemicals, Inc.

In an illustrative example, a RIM polyurethane formulation is approximately as follows: 15% NCO; 100 parts prepolymer; 20 parts Primax® PE particles and 18.7 parts methylene orthochloroaniline (MOCA) with a stoichiometry of 95%.

To control the thermal expansion of the liner it may be desirable to "fill" the polymer matrix with a mineral filler such as mica or glass which may be in the form of milled fibers, flakes or chopped glass strands. The amount used may be in the range from 5–20% by weight of the polymer matrix formed, depending upon how much the expansion of a heated liner is to be minimized.

It is critical that there be essentially no compressive deformation-if there is more than 1% compressive deformation at about 100° F., or more than 5% at 350° F., the material "works". Working of the material generates heat which is cumulative when the ambient temperature is about 80° F. or higher. The polymer will melt if it is sufficiently heated during operation of the car.

The test method used for measuring the compressive deformation of a polymer matrix is set forth in ASTM test D 621-64 titled Standard Test Method for Deformation of Plastics Under Load (re-approved 1988). It is a sensitive method which gives a measure of the ability of a rigid plastic in an assembly, to withstand compression without yielding and loosening the assembly over a period of time. The method also provides thermomechanical characteristics by measuring the elastic and loss moduli as a function of, frequency, time, or temperature, the last named being used herein because thermal degradation is the chief concern over the long period of time, usually ten (10) years, over which a railroad car operates without having the bowl liners replaced.

The test method used for measuring the tensile properties of a polymer matrix is set forth in ASTM test D 638-89 type I titled Standard Test Method for Tensile Properties of Plastics. The test was conducted at room temperature (25° C.) with specimens having a nominal thickness of 0.635 cm (0.250"), measuring from 0.15% in/in strain to 0.20% in/in strain.

With the above-described structure for holding a center plate in a bowl of a truck bolster, it is evident that there is no provision for minimizing the relative movement between the center plate and bowl, or the liner relative to either of the foregoing. However, such movement as does occur fails to produce any appreciable wear in the bowl or on the center plate because of the contrast between the hardnesses of the materials; the hardness of cast steel is about 270 BHN (Brinell hardness number) versus about Shore D 75 for the polymer. The effect of such little movement as does occur is further minimized because of the low coefficient of sliding friction of the polymer.

Figure 3:
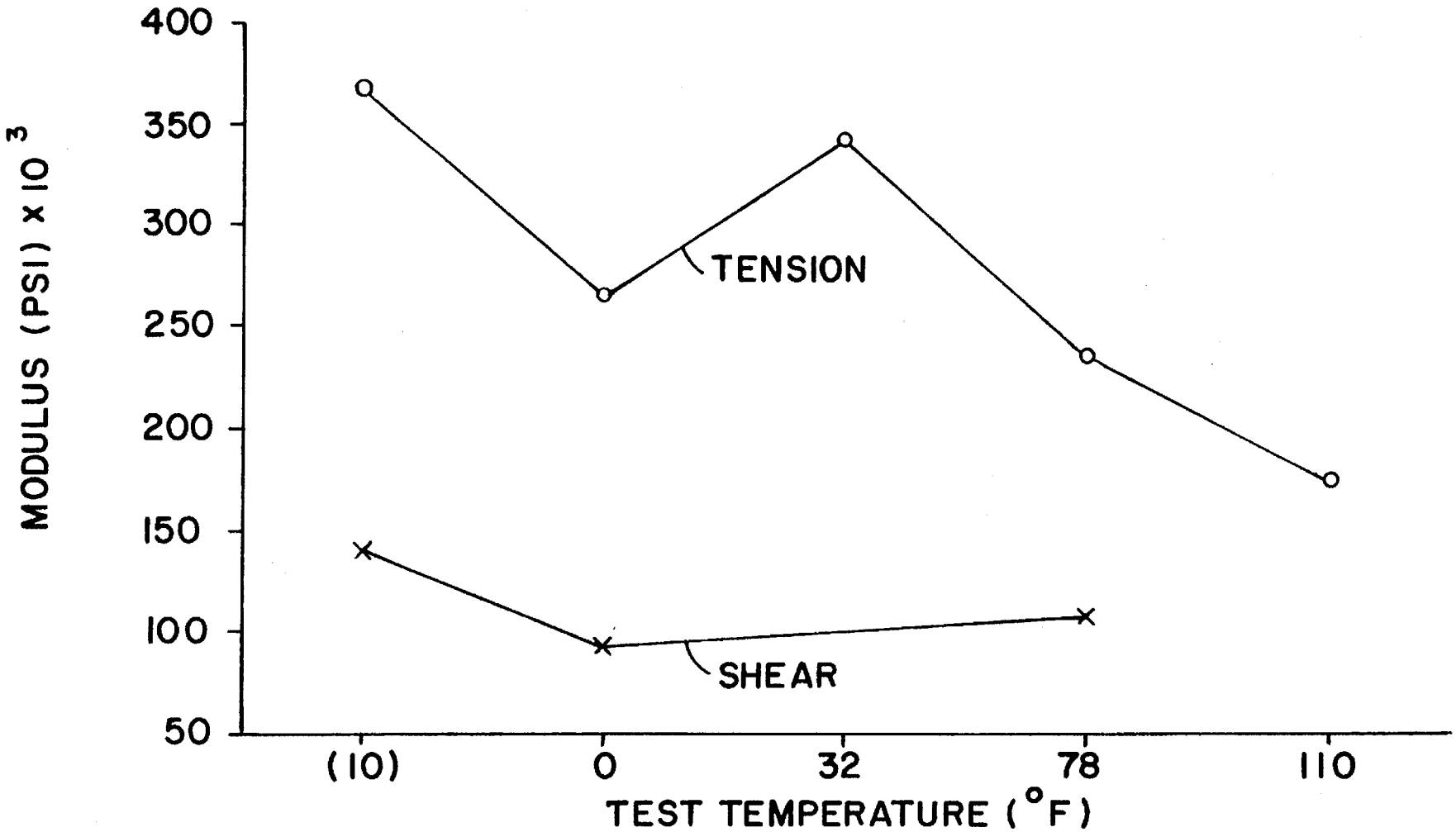
FIG. 3 is a graph in which is plotted the tension and shear moduli respectively, as a function of temperature, for the most preferred PE-containing Nyrim® triblock copolymer.

Referring now to FIG. 3 there is shown a graph for the modulus of elasticity in tension of XP-91 measured at different temperatures corresponding to the ambient temperatures expected to be encountered by a railroad car in normal operation in this country. Even at a temperature as high as 43° C. (110° F.) it is seen that the modulus is greater than 150,000 psi, and does not decrease at lower temperatures. The shear modulus in the range from −10° F. to 78° F. remains above 50,000 psi.

Figure 4:
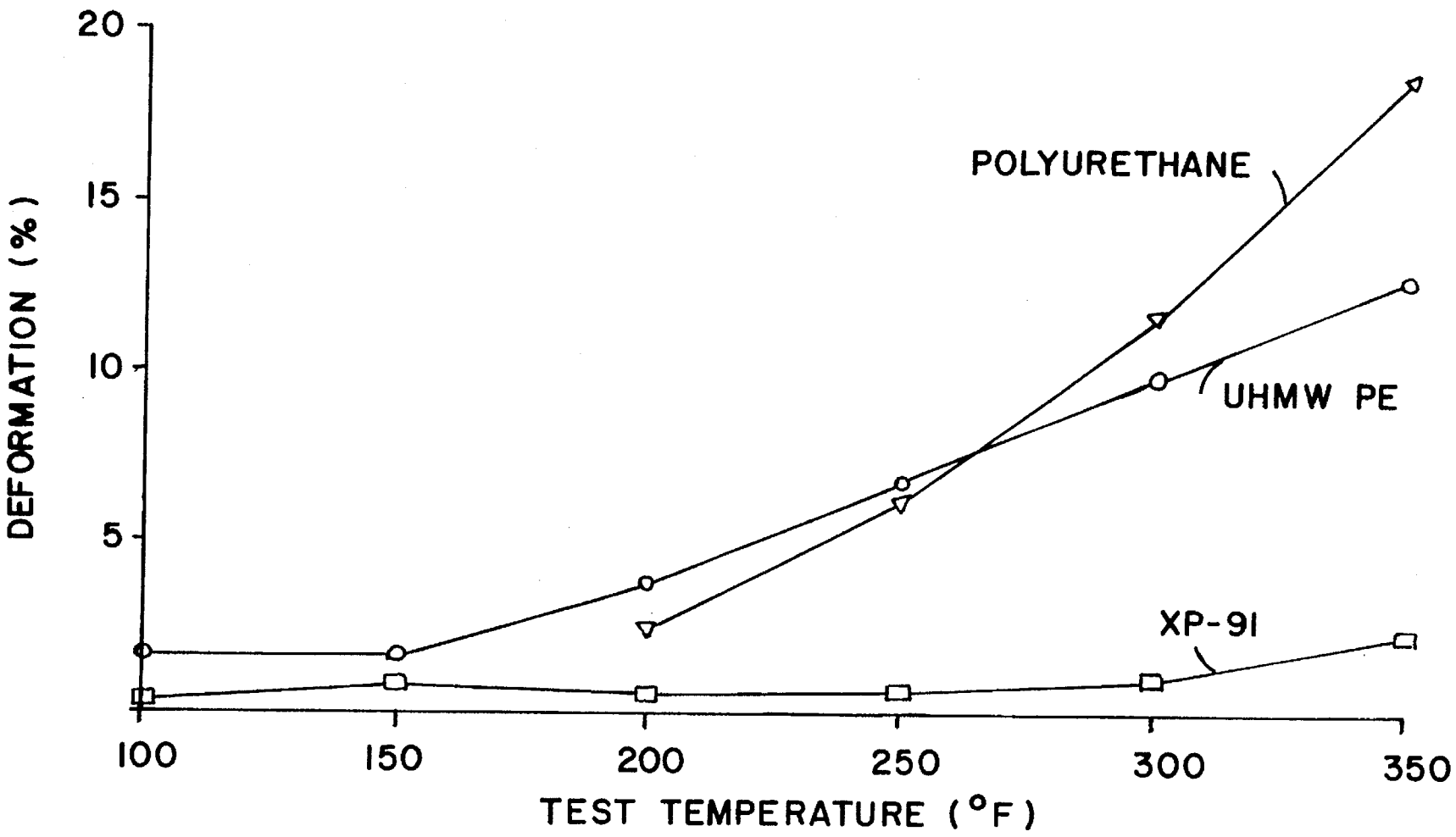
FIG. 4 is a graph in which is plotted the percent deformation as a function of temperature for (i) UHMW PE taught in the '951 patent; (ii) a cast polyurethane containing molybdenum sulfide having a Shore D <70, which is commercially available; and, (iii) a triblock copolymer of a major amount by weight of ϵ-aminocaproic acid (caprolactam) and a polyol prepolymer commercially available under the Nyrim® brand, having dispersed therein a minor amount of surface-modified polyethylene.

Referring now to FIG. 4 there is shown a graph for the compressive deformation (%) as a function of temperature (°F.), of two prior art materials, namely cast molybdenum-filled polyurethane (UMF), cast UHMW PE and XP-91, each so identified on the graph. As is evident, even at 350° F., the XP-91 suffers minimal compressive deformation and at 100° F., suffers essentially none. This indicates that the XP-91 is substantially non-deformable, rigid, and incompressible.

Figure 5:
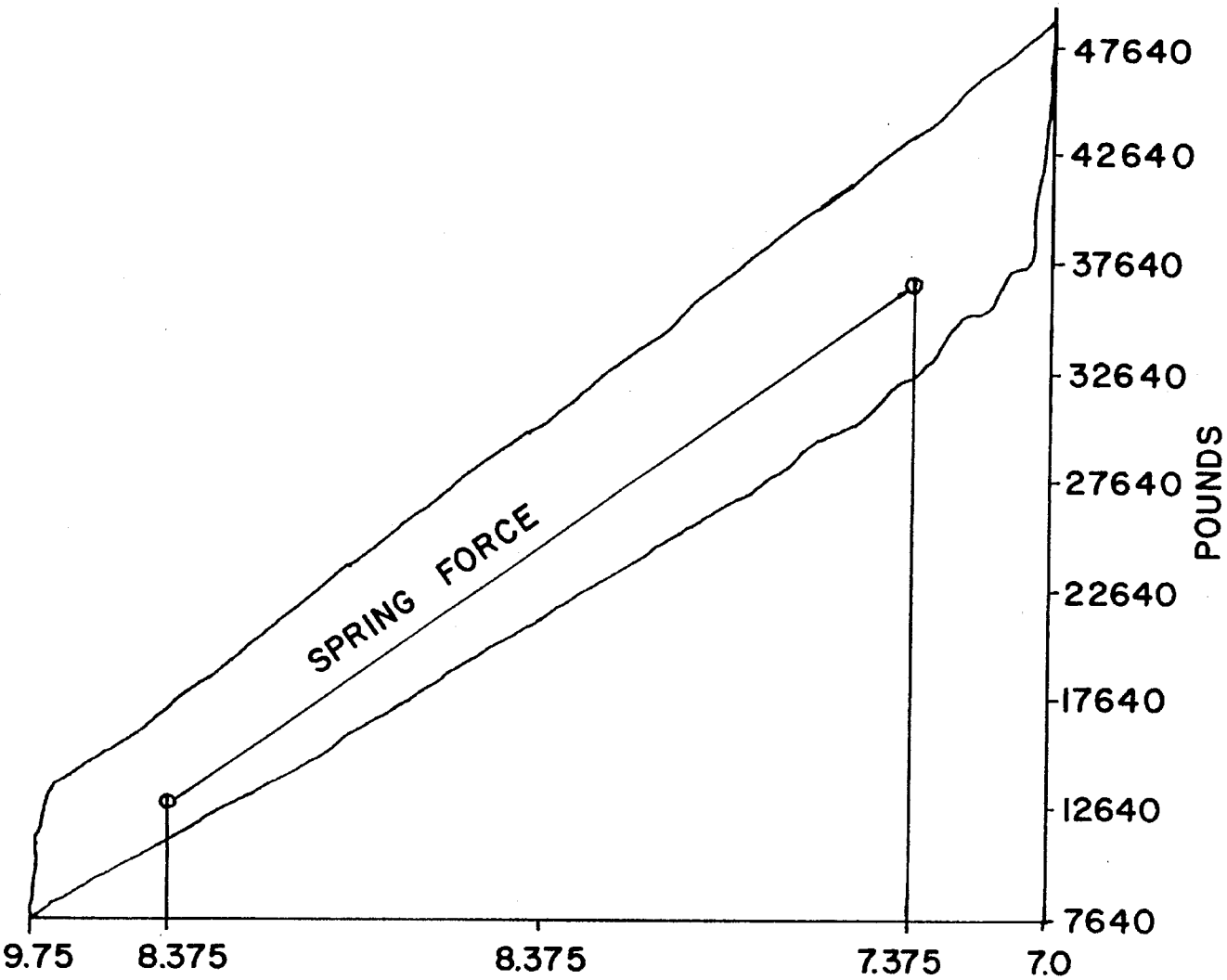
FIG. 5 is a hysterisis curve for a liner of acicular cast iron used as the benchmark against which the energy loss of liners of different polymers is measured.

Referring to FIG. 5 there is shown a hysterisis loop for acicular cast iron, this being the material of choice for a conventional non-polymer containing friction casting. Under a load which reached 48,800 lb the energy loss is calculated to be 24,000 in.lb.

Figure 6:
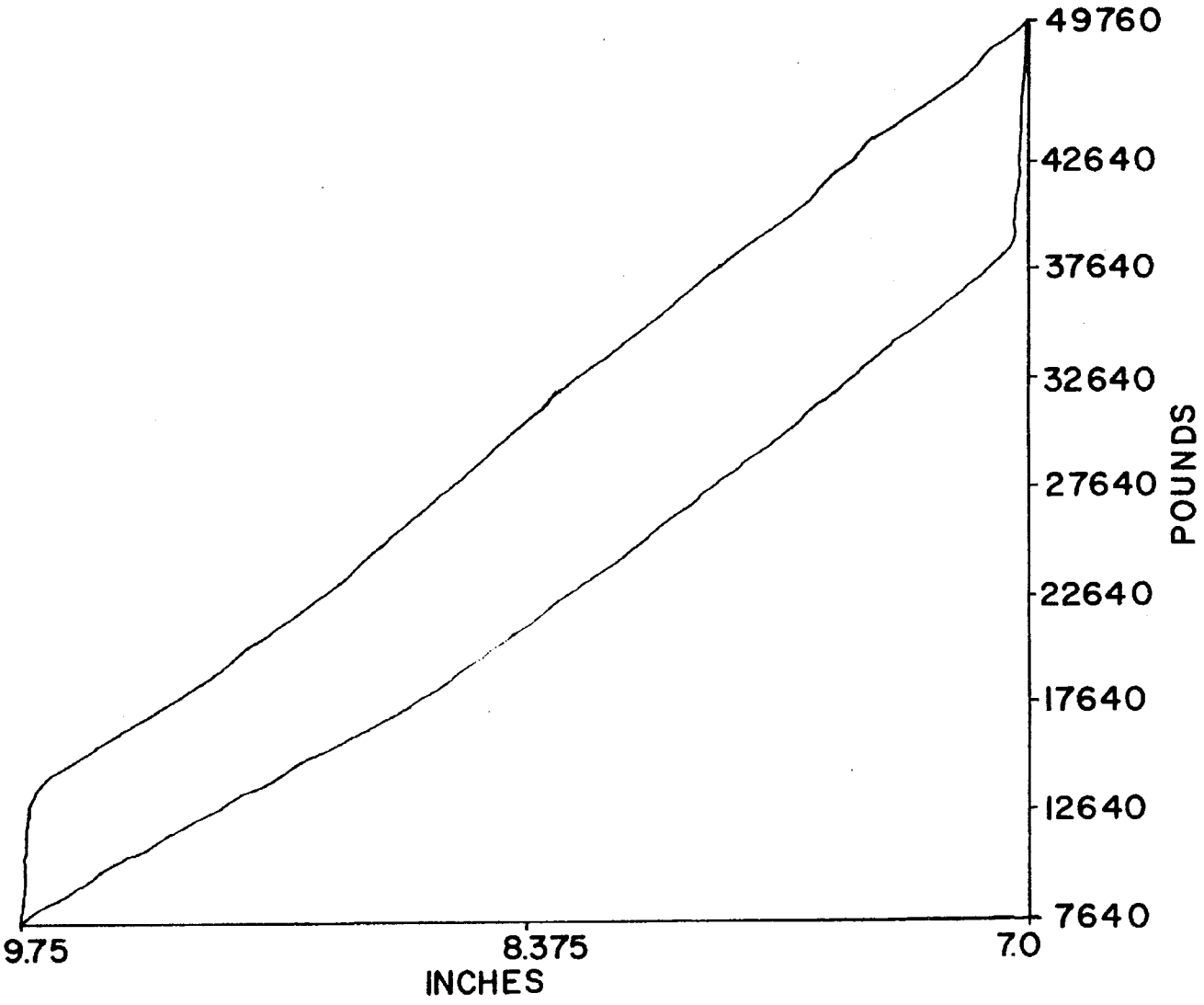
FIG. 6 is a hysterisis curve for a fully dense liner of RIM non-elastomeric polyurethane having molybdenum disulfide dispersed therein.

Referring to FIG. 6 there is shown a hysterisis loop for a RIM polyurethane filled with 5% by weight of molybdenum pentasulfide under a load which reached 49,760 lb. The reduction in energy loss is calculated to be 23,400 in.lb., indicating that, relative to the acicular cast iron, it has lost only 2.5%.

Figure 7:
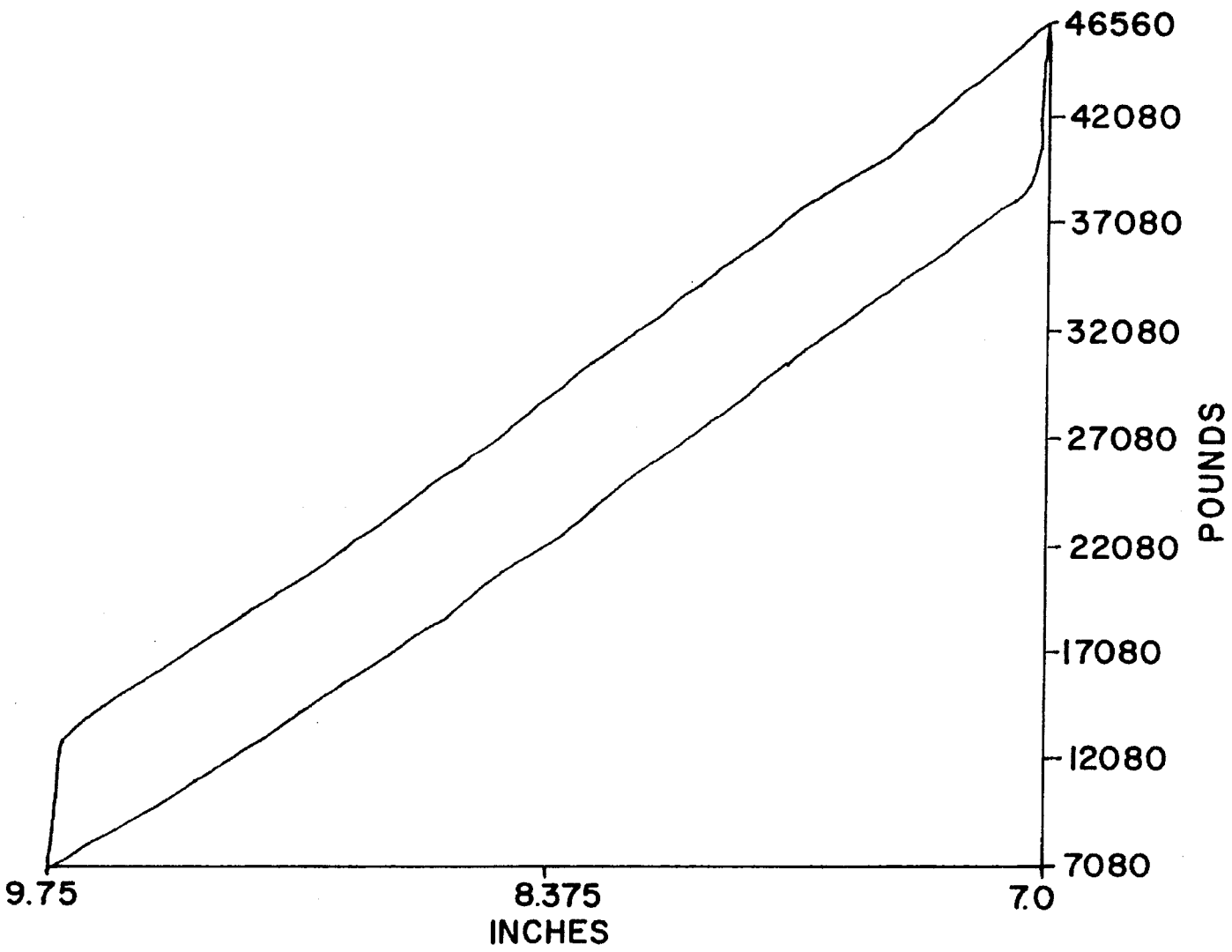
FIG. 7 is a hysterisis curve for a liner of cast polyurethane having a Shore D 60 hardness measured at 25.5° C.

Referring to FIG. 7 there is shown a hysterisis loop for a prior art cast polyurethane having a hardness of 60 Shore D, under a load which reached 46,560 lb. The reduction in energy loss is calculated to be 17,925 in.lb., indicating that, relative to the acicular cast iron, it has lost 25.0%.

Figure 8:
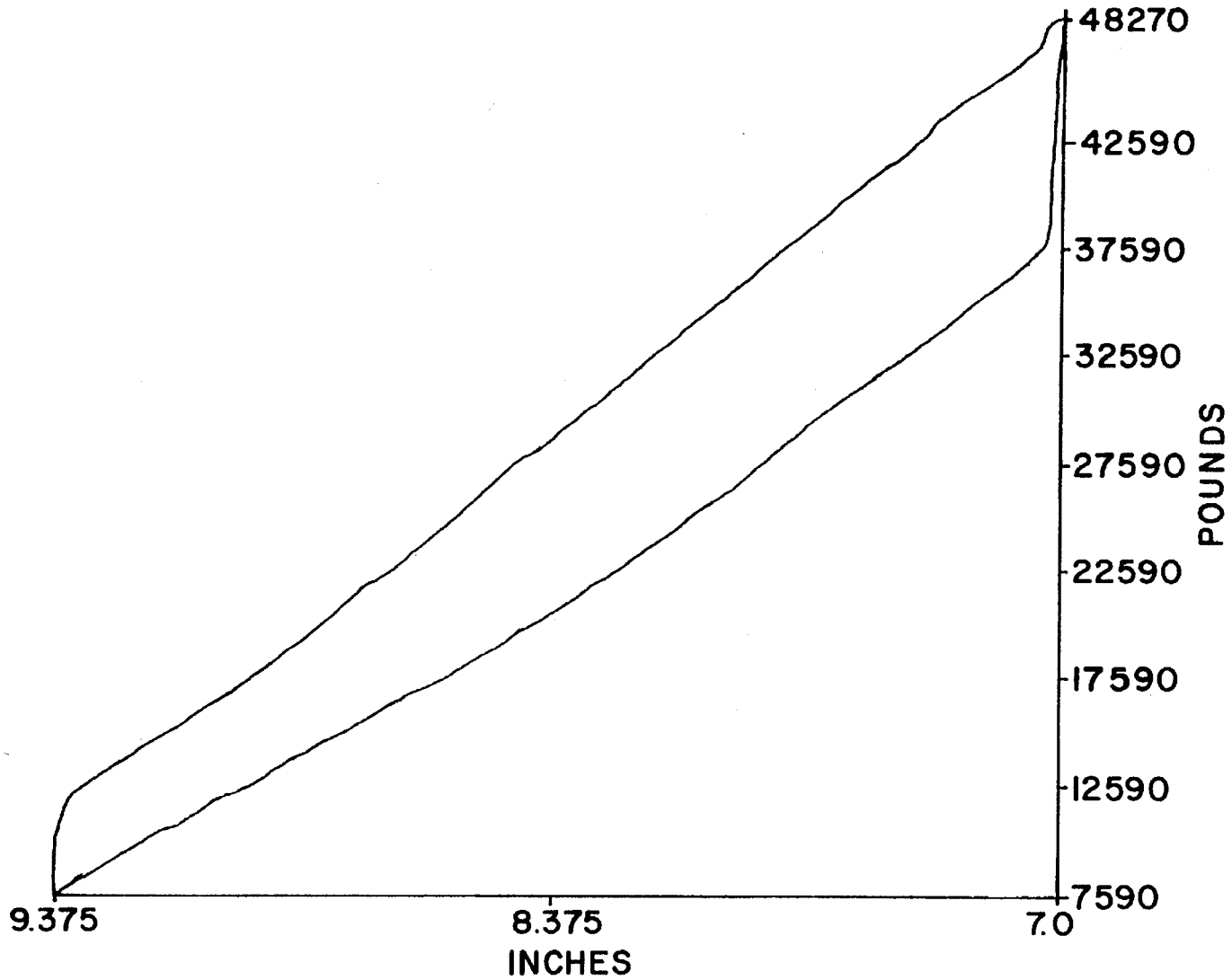
FIG. 8 is a hysterisis curve for the RIM liner of a Nyrim® copolymer having a Shore D 75 hardness measured at 25.5° C.

Referring to FIG. 8 there is shown a hysterisis loop for a RIM Nyrim® triblock copolymer filled with 5% by weight of surface modified PE under a load which reached about 48,000 lb. The reduction in energy loss is calculated to be 20,550 in.lb., indicating that, relative to the acicular cast iron, it has lost only 14%.

From the foregoing hysterisis curves it is evident that only a fully dense material provides less than 25% reduction in energy loss relative to acicular cast iron.

Having thus provided a general discussion, described the overall friction wedge in detail and illustrated the invention with specific examples of the best mode of carrying it out, it will be evident that the invention has provided an effective solution to a difficult problem. It is therefore to be understood that no undue restrictions are to be imposed by reason of the specific embodiments illustrated and discussed, and particularly that the invention is not restricted to a slavish adherence to the details set forth herein.

We claim:

1. A center plate assembly in combination with a truck bolster of a railroad car, to mount a car body upon said bolster so as to permit relative movement of said car and said track assembly about a vertical axis, comprising, a truck bolster having a central bowl-shaped right-cylindrical recess with a horizontal floor within which recess is swivelably mounted a disc-shaped center plate of said center plate assembly having a shape corresponding to that of said recess, except uniformly diminished, vertically and radially inwards from said recess's surface, by a distance corresponding to the thickness of a unitary liner interposed between said center plate and said floor of said recess, said liner comprising a substantially rigid and essentially non-deformable reaction injection molded polymer matrix having a hardness in the range from 70–90 Shore D, said liner being fully dense and resistant to the presence of a particulate contaminant between surfaces of said liner and said center plate assembly; being stable to thermal and oxidative degradation; having a modulus of elasticity in tension (tension modulus) of at least 689 MPa (100,000 psi); a modulus of elasticity in shear (shear modulus) of at least 350,000 kPa (50,000 psi); said tension modulus and said shear modulus each measured at room temperature 25.5° C. (78° F.); and having essentially no compressive deformation under pressure of 6900 kPa (1000 psi) and a temperature of 38.8° C. (100° F.); said liner having an exterior surface adapted to conform to said recess's inner surface before said center plate is thrust into said recess, and said liner having an inner surface adapted to conform to said center plate assembly's exterior surface at room temperature.

2. The combination of claim 1 wherein said polymer matrix has a durometer hardness in the range from 75–80 Shore D; a modulus of elasticity in tension (tension modulus) of at least 1,034 MPa (150,000 psi); mid, a modulus of elasticity in shear (shear modulus) of at least 689,000 kPa (100,000 psi); both measured at room temperature 25.5° C. (78° F.).

3. The combination of claim 2 wherein said polymer matrix has a tensile strength of at least 27500 kPa (4000 psi), measured at 25° C., with specimens having a nominal thickness of 0.635 cm (0.250"), measuring from 0.15% in/in strain to 0.20% in/in strain; and, said polymer matrix has a reduction in energy loss relative to acicular iron, of less than 25%.

4. The combination of claim 3 wherein said polymer matrix is selected from the group consisting of a (i) triblock copolymer of a polyol prepolymer and a ring-openable lactam; (ii) substantially crosslinked polyurethane; (ii) substantially crosslinked polyurea; (iv) substantially crosslinked polymer of one (homopolymer) or more (copolymer) cyclodiolefins; and (iv) nylon.

5. The combination of claim 4 wherein said compressive deformation of said liner under conditions set forth, is less than 1%.

6. The combination of claim 5 wherein said compressive deformation of said liner under pressure of 6,900 kPa (1000 psi) and a temperature of 177° C. (350° F.) is less than 5%.

7. The combination of claim 1 wherein said polymer matrix includes dispersed therein from 1 to 20% by weight of a surface modified polyolefin present in said polymer matrix as a disperse phase, said polymer matrix being present as a continuous phase.

8. The combination of claim 7 wherein said compressive deformation of said pad member under conditions set forth, is less than 1%.

9. The combination of claim 7 wherein said compressive deformation of said pad member under pressure of 6,900 kPa (1000 psi) and a temperature of 177° C. (350° F.) is less than 5%.

10. In a combination of a center plate assembly and a truck assembly, to permit relative rotational movement between a truck of a railroad car and its body about a vertical axis, wherein: a truck bolster has a bowl-shaped center recess in which is mounted said center plate assembly from which depends a horizontally disposed center plate seated for rotation within said center recess; a bowl-shaped wear liner disposed between facing bottom and sidewall surfaces of said center plate assembly and said recess's inner surface; and, said liner has an exterior surface adapted to conform to said recess's inner surface before said center plate is thrust into said recess, and has an inner surface adapted to conform to said center plate assembly's exterior surface at room temperature, the improvement comprising, said liner comprising a substantially rigid and essentially non-deformable reaction injection molded polymer matrix having a hardness in the range from 70–90 Shore D, said liner being fully dense and resistant to the presence of a particulate contaminant between surfaces of said liner and said center plate assembly; being stable to thermal and oxidative degradation; having a modulus of elasticity in tension (tension modulus) of at least 689 MPa (100,000 psi); a modulus of elasticity in shear (shear modulus) of at least 350,000 kPa (50,000 psi); said tension modulus and said shear modulus each measured at room temperature 25.5° C. (78° F.); and having essentially no compressive deformation under pressure of 6900 kPa (1000 psi) and a temperature of 38.8° C. (100° F.).

11. The combination of claim 10 wherein said polymer matrix has a durometer hardness in the range from 75–80 Shore D; a modulus of elasticity in tension (tension modulus) of at least 1,034 MPa (150,000 psi); and, a modulus of elasticity in shear (shear modulus) of at least 689,000 kPa (100,000 psi); both measured at room temperature 25.5° C. (78° F.).

12. The combination of claim 11 wherein said polymer matrix has a tensile strength of at least 27500 kPa (4000 psi), measured at 25° C., with specimens having a nominal thickness of 0.635 cm (0.250"), measuring from 0.15% in/in strain to 0.20% in/in strain; and, said polymer matrix has a reduction in energy loss relative to acicular iron, of less than 25%.

13. The combination of claim 12 wherein said polymer matrix is selected from the group consisting of a (i) triblock copolymer of a polyol prepolymer and a ring-openable lactam; (ii) substantially crosslinked non-elastomeric polyurethane; (ii) substantially crosslinked polyurea; (iv) substantially crosslinked polymer of one (homopolymer) or more (copolymer) cyclodiolefins; and (iv) nylon.

14. The combination of claim 13 wherein said compressive deformation of said liner under conditions set forth, is less than 1%.

15. The combination of claim 14 wherein said compressive deformation of said liner under pressure of 6,900 kPa (1000 psi) and a temperature of 177° C. (350° F.) is less than 5%.

16. The combination of claim 10 wherein said polymer matrix includes dispersed therein from 1 to 20% by weight of a surface modified polyolefin present in said polymer matrix as a disperse phase, said polymer matrix being present as a continuous phase.

17. The combination of claim 16 wherein said compressive deformation of said pad member under conditions set forth, is less than 1%.

18. The combination of claim 17 wherein said compressive deformation of said pad member under pressure of 6,900 kPa (1000 psi) and a temperature of 177° C. (350° F.) is less than 5%.

19. The combination of claim 18 wherein said polymer matrix is selected from the group consisting of (i) triblock copolymer of a polyol prepolymer and a ring-openable lactam; and (ii) substantially crosslinked non-elastomeric polyurethane.

* * * * *